United States Patent [19]

Peterpaul

[11] 4,357,969

[45] Nov. 9, 1982

[54] TIE DISCHARGE APPARATUS IN A BUNDLING TIE APPLYING TOOL

[75] Inventor: Joseph Peterpaul, West Orange, N.J.

[73] Assignee: Thomas & Betts Corporation, Raritan, N.J.

[21] Appl. No.: 203,690

[22] Filed: Nov. 3, 1980

[51] Int. Cl.[3] ..... B21F 9/02

[52] U.S. Cl. ..... 140/123.6; 140/93.2; 30/131; 83/167

[58] Field of Search ..... 140/93.2, 123.6, 93 R, 140/93 A; 100/6, 33 PB; 83/167; 30/124, 131

[56] References Cited

U.S. PATENT DOCUMENTS

| | | | |
|---|---|---|---|
| 3,391,440 | 7/1968 | Harms | 29/203 |
| 3,438,406 | 4/1969 | Rozmus | 140/93.2 |
| 3,515,178 | 6/1970 | Hidassy | 140/123.6 |
| 3,735,784 | 5/1973 | Obuch et al. | 140/93.2 |
| 3,746,055 | 7/1973 | Farkas et al. | 140/93.2 |
| 3,914,865 | 10/1975 | Oakes | 30/131 |
| 3,946,769 | 3/1976 | Caveney et al. | 140/93.2 |
| 4,047,545 | 9/1977 | Paradis | 140/123.6 |
| 4,093,005 | 6/1978 | Eberhardt et al. | 140/123.6 |
| 4,129,157 | 12/1978 | Sciolotto | 140/123.6 |

*Primary Examiner*—Lowell A. Larson

*Attorney, Agent, or Firm*—Robert M. Rodrick; Salvatore J. Abbruzzese; Jesse Woldman

[57] ABSTRACT

A container of clear material is provided in a bundling tie applying tool for deflecting and collecting severed tie portions expelled from the tool through a port of egress. The container comprises a first enclosure portion attached to the housing and including a deflecting surface positioned to be in the path of tie discharge. A second enclosure portion is removably attached to the first portion to provide for disposal of accumulated severed tie portions therein. The tie container further includes means communicating with the port of egress for permitting passage therethrough while preventing feedback of discharged or deflected tie portions to the port of egress to thereby prevent clogging or jamming of the tool during operation.

17 Claims, 4 Drawing Figures

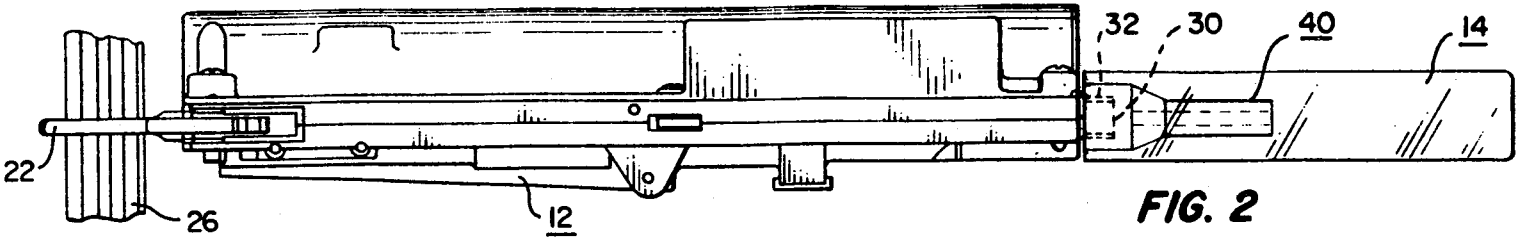
FIG. 2
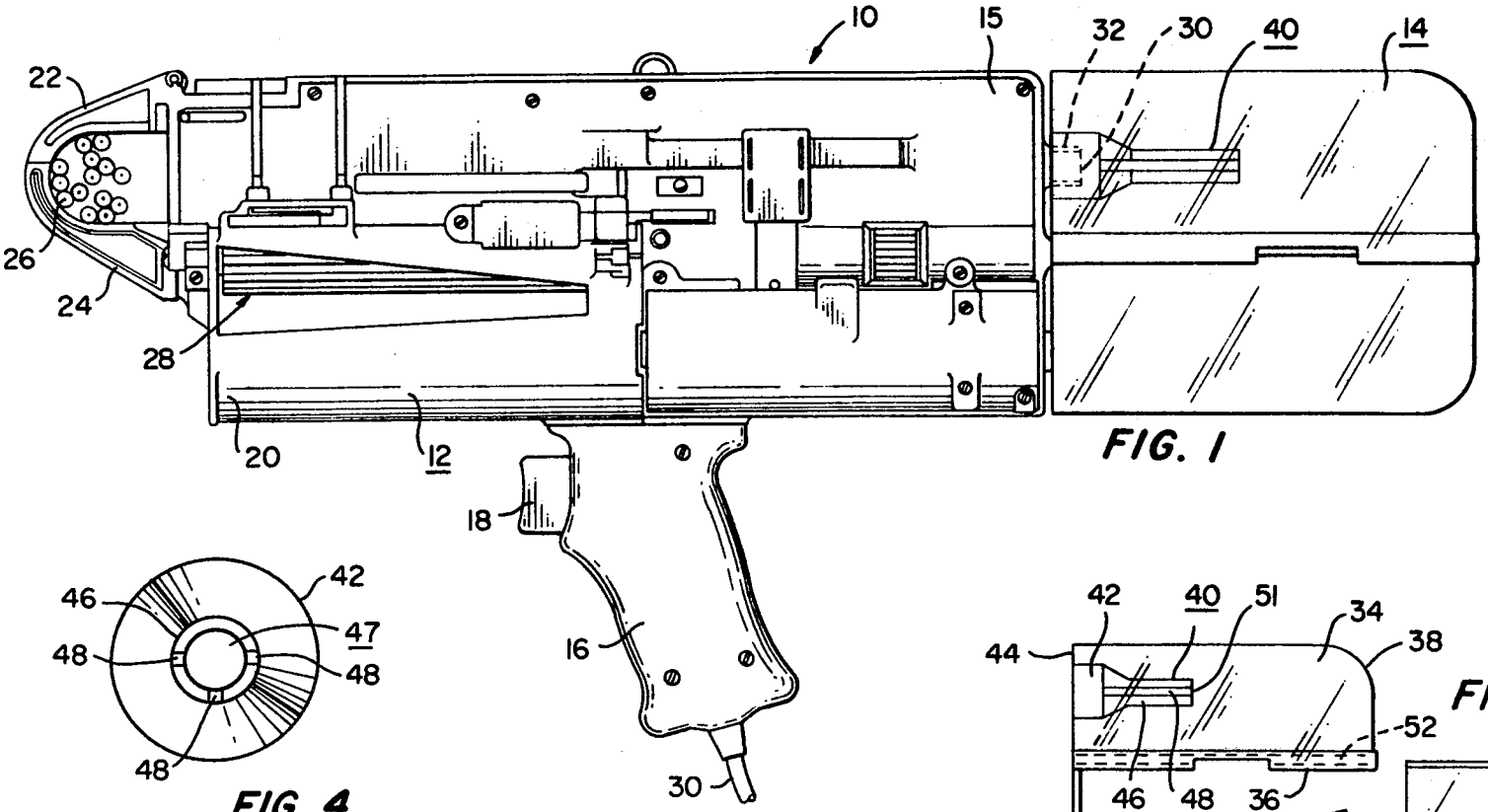
FIG. 1
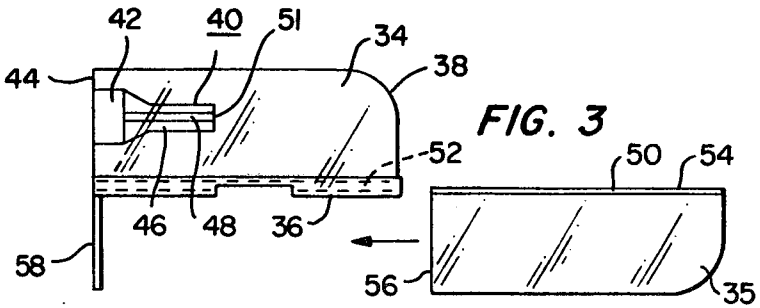
FIG. 3
FIG. 4

TIE DISCHARGE APPARATUS IN A BUNDLING TIE APPLYING TOOL

FIELD OF THE INVENTION

This invention relates to a bundling tie applying tool and, more specifically to an apparatus in such a tool for preventing tool jamming upon discharge of severed excess tie portions from the tool. The present invention is particularly, but not exclusively, useful in the type of tool disclosed in copending patent application, Ser. No. 203,687, filed concurrently herewith, entitled "Bundling Tie Applying Tool," and assigned to the same assignee as is the present invention.

BACKGROUND OF THE INVENTION

Tools for applying bundling ties about wires in harnesses or about other articles are generally known and may be manual, semi-automatic or automatic. Because of high production demands, the automatic tool has become popular. The automatic tool typically includes means for positioning a bundling tie about the wires, tensioning the ties and then severing the tie upon being suitably tensioned. Ejection means are commonly provided to discharge the excess severed tie portions from the tool. In some tools, the scrap tie portions are propelled from the tool at a relatively high speed, posing a hazard for the tool operator.

In several known tools, devices are utilized to deflect and blunt the propelled severed tie portions so as to reduce the velocity of the discharged tie portions and cause them to fall harmlessly from the tool. A problem associated with the use of devices or guides to control the discharge of severed tie portions is in jamming of the tool during operation. The use of restricted openings or deflector plates to hinder the free travel of the severed tie portions has a tendency, in particular with continuous, rapid tool operation, to cause clogging of scrap portions within the tool, thus rendering the tool inoperable and resulting in costly time delay and potential tool damage.

SUMMARY OF THE INVENTION

It is an object of the present invention to provide an improved apparatus for the discharge of scrap tie portions from a bundling tie applying tool.

It is another object of the present invention to provide a tie deflecting and collecting device with provision to prevent clogging of the tie scrap discharge port.

According to the invention, tie discharge apparatus is provided in a bundling tie applying tool. The tool is of the type having a housing, a port of egress on the housing for the discharge of a severed tie portion and means for ejecting the severed tie portion through the port of egress in a path of discharge. The tie discharge apparatus comprises a member attached to the housing having a tie deflecting surface externally of the housing in the path of discharge. Included is means communicating with the port of egress for permitting passage therethrough of a severed tie portion to said tie deflecting surface and for preventing the return of such severed tie portion to said port of egress.

In the preferred form, the passage means includes an elongate, generally cylindrical hollow tube having an aperture therethrough in communication with the port of egress. The tube has a plurality of radially spaced, longitudinally extending slots extending through its wall into the aperture. The slots are formed to be of width to allow close passage of a severed tie portion therethrough.

In another arrangement, a tie container is provided comprising tie collecting means attached to the tool housing and defining an enclosure in communication with the port of egress for receiving and collecting severed tie portions therein. The tie container includes means within the enclosure communicating with the port of egress for permitting passage of a severed tie portion therethrough and for preventing feedback of a severed tie portion to the port of egress. Preferably, the collecting means comprises a first enclosure portion including a tie deflecting surface and a second enclosure portion removably attached to the first portion for disposal of severed tie portions accumulated therein.

BRIEF DESCRIPTION OF THE DRAWING

FIG. 1 is a side elevational view of a power-operated, automatic bundling tie applying tool embodying the present invention.

FIG. 2 is a top plan view of the tool of FIG. 1.

FIG. 3 is a side elevational exploded view showing the tie container assembly of FIG. 1 in a disassembled condition.

FIG. 4 is an enlarged end elevational view of a tie anti-clogging member shown in FIG. 3.

DESCRIPTION OF THE PREFERRED EMBODIMENTS

Referring to the drawing, there is shown in FIGS. 1 and 2 an automatic bundling tie applying tool, generally indicated as numeral 10, incorporating features of the present invention. The tool 10 is preferably of the type as shown and described in copending patent application, U.S. Ser. No. 203,637, entitled "Bundling Tie Applying Tool," filed on even date herewith, and assigned to the same assignee as is the present invention. In brief, the tool 10 is an electrically powered tool capable of installing a bundling tie of the type having an apertured head portion and an elongate, flexible strap portion extending therefrom. The tool 10 has means for receiving ties individually from a series of such bundling ties interconnected between adjacent head portions by a web. Means are included in the tool 10 for advancing the ties to a separating station whereat the web between each head portion is cut thereby providing separated, individual ties. The separated ties are further advanced to a feeding station whereat a reciprocating member feeds and positions an individual bundling tie in a closed loop about the articles to be bundled. Included are means for tensioning the tie about the articles and means for severing the tensioned tie, preferably at a predetermined tension.

Generally, the tool 10 comprises a housing 12, and, in accordance with the present invention, a scrap container assembly 14 suitably attached to the rearward housing end 15. A handle 16 with a trigger 18 mounted therein is provided. At the forward end 20 of the housing 12 where the ties are applied to a bundle of articles, there are a pair of hook members 22 and 24. The lower hook member 24 is stationary while the upper hook member 22 is movable with respect thereto. The movable upper hook 22 is movable to a position for receipt of a plurality of wires 26 to be bundled. Once the wires 26 have been received within the confines of the hooks 22 and 24, the upper hook is closed to facilitate looping of a cable bundling tie about the wires 26. The tool 10 includes a tie carrying mechanism 28 for supporting a plurality of ties thereon and subsequently advancing the ties to a position in preparation for looping about the wires 26.

After a bundling tie is suitably positioned about the wires, the tie is tensioned and the excess strap portion of the tie is severed. Ejecting means (not shown) is included in the tool for discharging the excess severed tie portion through an egress aperture 30 in a discharge port 32 mounted on the housing end 15 in communication with the tie ejecting means (not shown). According to the invention, the scrap container assembly 14 suitably collects the excess severed tie portions and prevents clogging of the egress aperture 30, as will be described. In addition, as the ejecting means is capable of propelling the severed tie portion through the aperture 30 at a high velocity, the scrap container assembly 14 also provides means for deflecting a severed tie portion for protection of the tool operator.

According to the invention, the scrap container assembly 14, as shown in FIG. 3, comprises an upper deflector portion 34 and a lower collector portion 35 that is removably attached to the deflector portion 34. The deflector portion 34 comprises walls defining an enclosure with an open surface area 36 at the bottom. One of the walls 38 is preferably curved and positioned to lie in the path of a severed tie portion discharged through the aperture 30 and in facing relation to the open surface area 36. Accordingly, the curved wall 38 is adapted to be struck by expelled ties and deflected downwardly thereby through the open area 36. The wall 38 may also be straight or angularly disposed with respect to the discharge path of severed tie portions that are expelled through the egress aperture 30.

Within the deflector portion 34 is a hollow, tie anti-clogging member 40, preferably of generally cylindrical configuration, adapted to prevent feedback of expelled or deflected tie portions to the egress aperture 30, thereby negating clogging or jamming of the tool 10. The member 40 has a coupling portion 42 adapted to be coupled to the housing discharge port 32, preferably by screw threads. In the preferred arrangement, the coupling portion 42 is affixed to a wall 44 of the deflector portion 36. Thus, upon attachment of the coupling portion 42 to the discharge port 32, the deflector portion 36 is also secured to the housing 12.

As illustrated in FIG. 3 and FIG. 4, adjacent the coupling portion 42 is a hollow, elongate tubular portion 46 having a central aperture 47 and a plurality of radially spaced, longitudinally extending slots 48 extending through its wall. The aperture 47 within the hollow tubular portion 46 is adapted to communicate with the egress aperture 30 when the coupling portion 42 is attached to the port 32. The slots 48 may extend partially into and through the coupling portion 42. The slots are formed to have a width slightly greater than the width of the strap portion of a bundling tie used in the tool. In the preferred arrangement, shown in FIG. 4, three slots 48 are provided, two of the three slots 48 being disposed approximately diammetrically opposite each other in a common plane with the third slot approximately evenly disposed at ninety degrees between the two opposite slots. It is preferable that the third such slot be oriented at the bottom of the member 40 when coupled to the port 32 with the other two slots in a substantially horizontal plane. It has been found that in such a structure the severed tie scraps are permitted to pass radially through the narrow slots 48 or longitudinally out from the end 51 of the aperture 47 during ejection while being prevented from returning to and clogging the egress area regardless of tool orientation. Tie portions passing through the slots 48 or through the open end 51 may fall directly through the open surface area 36 of the deflector portion 34 or, depending upon their discharge velocity, may be deflected off the walls of the deflector portion 34 down through the open surface area 36.

The removable collector portion 35 preferably has a cammed key 50 adapted to snap onto or slidably engage a keyway 52 on the deflector portion 34 for securement thereto. Other fastening means, such as clamps, for example, may also be used to removably attach the collector portion 35 to the deflector portion 34. The collector portion 35 has an open top surface area 54 adapted to communicate with the open area 36 of the deflector portion 34 when assembled. The collector portion 35 also has an open side area 56 that is enclosed by a projecting wall 58 of the deflector portion 34 in assembly. It should be understood, however, that the collector portion 35 may have walls defining a complete enclosure except for the open top area 54 and that the projecting wall 58 on the deflector portion 34 may be eliminated. The collector portion 35 receives through the open top area 54 severed tie portions that are discharged through the anti-clogging member 40 and which may be deflected by the deflector portion 34. Severed tie portions are held therein until the collector portion 35 is filled, at which time the collector portion 35 may be removed for disposal of the scrap. The tool 10 may be used without the collector portion 35, utilizing the deflector portion 34 to deflect ejected scrap portions through the bottom open area 36 away from the operator end onto the floor of the work area. In the preferred embodiment, both the deflector portion 34 and the collector portion 35 are made of clear plastic material to provide a visual inspection of the scrap ejection and collection.

Although the present invention is described herein in the context of an automatic power-operated bundling tie applying tool capable of receiving a series of webbed ties and cutting the webs therein, it should be appreciated that the contemplated scope of the invention is not so limited. For example, the invention may be used in tools for applying bundling ties wherein separate ties are supplied individually to the tool from a cartridge, hose or other loading device. Moreover, the tools may also be semi-automatically operable or manual.

Various other changes to the foregoing, specifically disclosed embodiments and practices will be evident to those skilled in the art. Accordingly, the foregoing preferred embodiments are intended in an illustrative and not in a limiting sense. The true spirit and scope of the invention are set forth in the following claims.

What is claimed is:

1. In a bundling tie applying tool of the type having a housing, a port of egress on said housing for the discharge of a severed bundling tie portion and means for ejecting said severed tie portion through said port of egress in a path of discharge, tie discharge apparatus comprising:

a member attached to said housing having a tie deflecting surface externally of said housing in said path of discharge; and means communicating with said port of egress for permitting passage therethrough of a severed tie portion to said tie deflecting surface and for preventing the return of such severed tie portion to said port of egress.

2. An apparatus according to claim 1, wherein said tie deflecting surface is disposed angularly with respect to said path of discharge.

3. An apparatus according to claim 2, wherein said member comprises a first portion including said tie deflecting surface and walls defining an enclosure having an open surface.

4. An apparatus according to claim 3, wherein said open surface is disposed in facing relation to said angularly disposed tie deflecting surface.

5. An apparatus according to claim 3, wherein said member comprises a second portion removably attached to said first portion for enclosing said open surface.

6. An apparatus according to claim 5, wherein said second portion includes walls defining an enclosure having an open surface, the open surface of said second portion adapted to communicate with the open surface of said first portion at attachment.

7. An apparatus according to claim 1, wherein said means for permitting passage comprises an elongate, generally cylindrical tube having an aperture therethrough in communication with said port of egress.

8. An apparatus according to claim 7, wherein said tube includes a plurality of radially spaced, longitudinally extending slots extending through the wall of said tube, said slots being of width to allow close radial passage of said severed tie portion therethrough.

9. An apparatus according to claim 8, wherein said tube comprises three such slots, two of said slots being disposed in a common plane extending longitudinally through said tube, the third slot being oriented approximately ninety degrees with respect to said common plane.

10. In a bundling tie applying tool of the type having a housing, a port of egress on said housing for the discharge of a severed bundling tie portion and means for ejecting said severed tie portion through said port of egress in a path of discharge, a tie container, comprising:

tie collecting means attached to said housing defining an enclosure in communication with said port of egress for receiving and collecting severed tie portions therein; and means within said enclosure communicating with said port of egress for permitting passage of a severed tie portion therethrough and for preventing feedback of said severed tie portion to said port of egress.

11. A tie container according to claim 10, wherein said tie collecting means includes means disposed in the path of tie discharge for deflecting said ties from said path.

12. A tie container according to claim 10, wherein said collecting means comprises a first enclosure portion and a second enclosure portion removably attached to said first enclosure portion for disposal of severed tie portions accumulated therein.

13. A tie container according to claim 12 wherein said first enclosure portion includes a tie deflecting surface positioned to be in the tie discharge path.

14. A tie container according to claim 10, wherein said means for permitting passage comprises an elongate, generally cylindrical tube having an aperture therethrough in communication with said port of egress.

15. A tie container according to claim 14, wherein said tube includes a plurality of radially spaced, longitudinally extending slots extending through the wall of said tube, said slots being of width to allow close radial passage of a severed tie portion therethrough.

16. A tie container according to claim 15, wherein said tube comprises three such slots, two of said slots being disposed approximately diametrically opposite each other and the third slot disposed substantially evenly between said two slots.

17. A tie container according to claim 10, wherein said collecting means is made of clear material for a visual observation of the collection of severed tie portions.

* * * * *